US007762359B1

(12) United States Patent
Miess

(10) Patent No.: US 7,762,359 B1
(45) Date of Patent: Jul. 27, 2010

(54) CUTTER ASSEMBLY INCLUDING ROTATABLE CUTTING ELEMENT AND DRILL BIT USING SAME

(75) Inventor: David P. Miess, Highland, UT (US)

(73) Assignee: US Synthetic Corporation, Orem, UT (US)

( * ) Notice: Subject to any disclaimer, the term of this patent is extended or adjusted under 35 U.S.C. 154(b) by 204 days.

(21) Appl. No.: 11/895,245

(22) Filed: Aug. 22, 2007

(51) Int. Cl.
*E21B 10/46* (2006.01)

(52) U.S. Cl. ..... 175/432; 175/426; 175/354

(58) Field of Classification Search ..... 175/354, 175/355, 426, 432, 342
See application file for complete search history.

(56) References Cited

U.S. PATENT DOCUMENTS

| | | | | |
|---|---|---|---|---|
| 4,073,354 | A | 2/1978 | Rowley et al. | |
| 4,200,159 | A | 4/1980 | Peschel et al. | |
| 4,201,421 | A | 5/1980 | Den Besten et al. | |
| 4,222,446 | A | 9/1980 | Vasek | |
| 4,350,215 | A | 9/1982 | Radtke | |
| 4,396,077 | A | 8/1983 | Radtke | |
| 4,553,615 | A | 11/1985 | Grainger | |
| 4,654,947 | A | 4/1987 | Davis | |
| 4,751,972 | A * | 6/1988 | Jones et al. | 175/431 |
| 4,756,631 | A * | 7/1988 | Jones | 384/95 |
| 4,815,342 | A | 3/1989 | Brett et al. | |
| 6,073,524 | A | 6/2000 | Weiss et al. | |
| 6,408,958 | B1 | 6/2002 | Isbell et al. | |
| 2007/0079991 | A1 | 4/2007 | Cooley et al. | |
| 2007/0278017 | A1 * | 12/2007 | Shen et al. | 175/426 |
| 2008/0017419 | A1 * | 1/2008 | Cooley et al. | 175/286 |
| 2008/0251293 | A1 * | 10/2008 | Mumma et al. | 175/57 |
| 2009/0020339 | A1 * | 1/2009 | Sherwood, Jr. | 175/426 |

* cited by examiner

*Primary Examiner*—Giovanna C Wright
(74) *Attorney, Agent, or Firm*—Workman Nydegger

(57) ABSTRACT

A cutter assembly including a rotatable cutting element, a rotary drill bit that may employ such a cutter assembly, and a method of fabricating a cutter assembly are disclosed. In one embodiment of the present invention, a cutter assembly comprises a housing including a recess. A cutting element may be received by and rotatable within the recess of the housing. The cutting element includes a substrate and a superabrasive table that is attached to the substrate. At least one of the substrate and the superabrasive table includes surface features configured to promote rotation of the cutting element within the housing during cutting.

19 Claims, 14 Drawing Sheets

CUTTER ASSEMBLY INCLUDING ROTATABLE CUTTING ELEMENT AND DRILL BIT USING SAME

TECHNICAL FIELD

One or more embodiments of the present invention relate to a cutter assembly including a rotatable cutting element, a rotary drill bit that may employ such a cutter assembly, and a method of fabricating a cutter assembly.

BACKGROUND

Wear-resistant, superabrasive cutting elements are currently used in rotary drill bits for drilling a borehole in a subterranean formation. Polycrystalline diamond compacts ("PDCs") have found particular utility as superabrasive cutting elements for such rotary drill bits. FIGS. 1 and 2 are isometric and top elevation views, respectively, of a prior art rotary drill bit 100 that utilizes a plurality of PDCs as cutting elements. The rotary drill bit 100 comprises a bit body 102 that includes radially- and longitudinally-extending blades 104 having leading faces 106. The bit body 102 further includes a threaded pin connection 108 for connecting the bit body 102 to a drilling string. Circumferentially adjacent blades 104 define so-called junk slots 109 therebetween. The bit body 102 defines a leading end structure for drilling into a subterranean formation by rotation of the bit body 102 about a longitudinal axis 110 and application of weight-on-bit. The bit body 102 also may include a plurality of nozzle cavities 111 for communicating drilling fluid from the interior of the bit body 102 to a plurality of fixed cutting elements 112 during drilling.

As best shown in FIG. 2, each of the cutting elements 112 may be secured to one of the blades 104. Each of the cutting elements 112 may include a polycrystalline diamond ("PCD") table 114 bonded to a substrate 116 (e.g., a cemented tungsten carbide substrate). For example, each of the cutting elements 112 may be attached to one of the blades 104 by brazing or press-fitting the substrate 116 of each of the cutting elements 112 to a corresponding blade 104 (e.g., within corresponding cutter pockets formed within each blade 104).

Due to the cutting elements 112 being attached to the bit body 102, only a portion of each cutting element 112 is subjected to extensive abrasive wear during drilling. FIG. 3 is a partial, side cross-sectional view depicting wear of one of the cutting elements 112 during drilling. As shown in FIG. 3, the cutting element 112 bears against and penetrates a subterranean formation 300 during drilling. Only a portion of a circumferential cutting edge 302 of each cutting element 112 is subjected to extensive abrasive wear during drilling. The cutting effectiveness of the cutting elements 112 substantially diminishes as a result of the localized wear of the circumferential cutting edge 302. This localized wear can necessitate replacing or rotating the cutting elements 112 despite most of the PCD tables 114 of the cutting elements 112 being relatively unaffected by the drilling. Alternatively, wear may extend into the substrate 116, which may also necessitate replacement of the cutting elements 112.

A number of different types of passive, rotatable cutting elements have been designed to purportedly attempt to reduce localized wear of a cutting element during drilling. Typically, such rotatable cutting elements including a PDC received by and rotatable within a housing that is attached to a bit body of a rotary drill bit. During drilling, the PDCs can rotate so that wear thereof may not be as localized as with a fixed cutting element, such as the cutting elements 112 shown in FIGS. 1-3.

However, unpredictability of the nature of contact between a rotatable PDC and a subterranean formation being drilled, extreme temperatures, forces, and pressures encountered in subterranean drilling environments may prevent or at least inhibit rotation of a conventional rotatable PDC. Thus, such conventional rotatable PDCs, as with fixed cutting elements, may exhibit a circumferential cutting edge that still locally degrades and wears down, resulting in decreased operational lifetime and drilling efficiency.

Therefore, there is still a need in the art for a cutting element for use in a rotary drill bit that more uniformly wears during use and, consequently, exhibits an increased operational lifetime.

SUMMARY

A cutter assembly including a rotatable cutting element, a rotary drill bit that may employ such a cutter assembly, and a method of fabricating a cutter assembly are disclosed. In one embodiment of the present invention, a cutter assembly comprises a housing including a recess. A cutting element may be received by and rotatable within the recess of the housing. The cutting element includes a substrate and a superabrasive table that is attached to the substrate. At least one of the substrate and the superabrasive table includes surface features configured to promote rotation of the cutting element within the housing during drilling.

In another embodiment of the present invention, a drill bit includes a bit body configured to engage a subterranean formation. A plurality of cutter assemblies are affixed to the bit body. At least one of the cutter assemblies includes a housing secured to the bit body. A cutting element may be received by and rotatable within the recess of the housing. The cutting element includes a substrate and a superabrasive table that is attached to the substrate. At least one of the substrate and the superabrasive table includes surface features configured to promote rotation of the cutting element within the housing during drilling of the subterranean formation.

BRIEF DESCRIPTION OF THE DRAWINGS

The drawings illustrate various embodiments of the present invention, wherein like reference numerals refer to like or similar elements in different views or embodiments shown in the drawings.

DETAILED DESCRIPTION

Various embodiments of the present invention relate to a cutter assembly including a rotatable cutting element, a rotary drill bit that may employ such a cutter assembly, and a method of fabricating a cutter assembly. As will be discussed in more detail below, in certain embodiments of the present invention, the rotatable cutting element includes surface features configured to promote rotation of the cutting element during drilling a subterranean formation and, thus, may result in more uniform wear and enhanced operational lifetime of the cutting element.

Figure 4A:
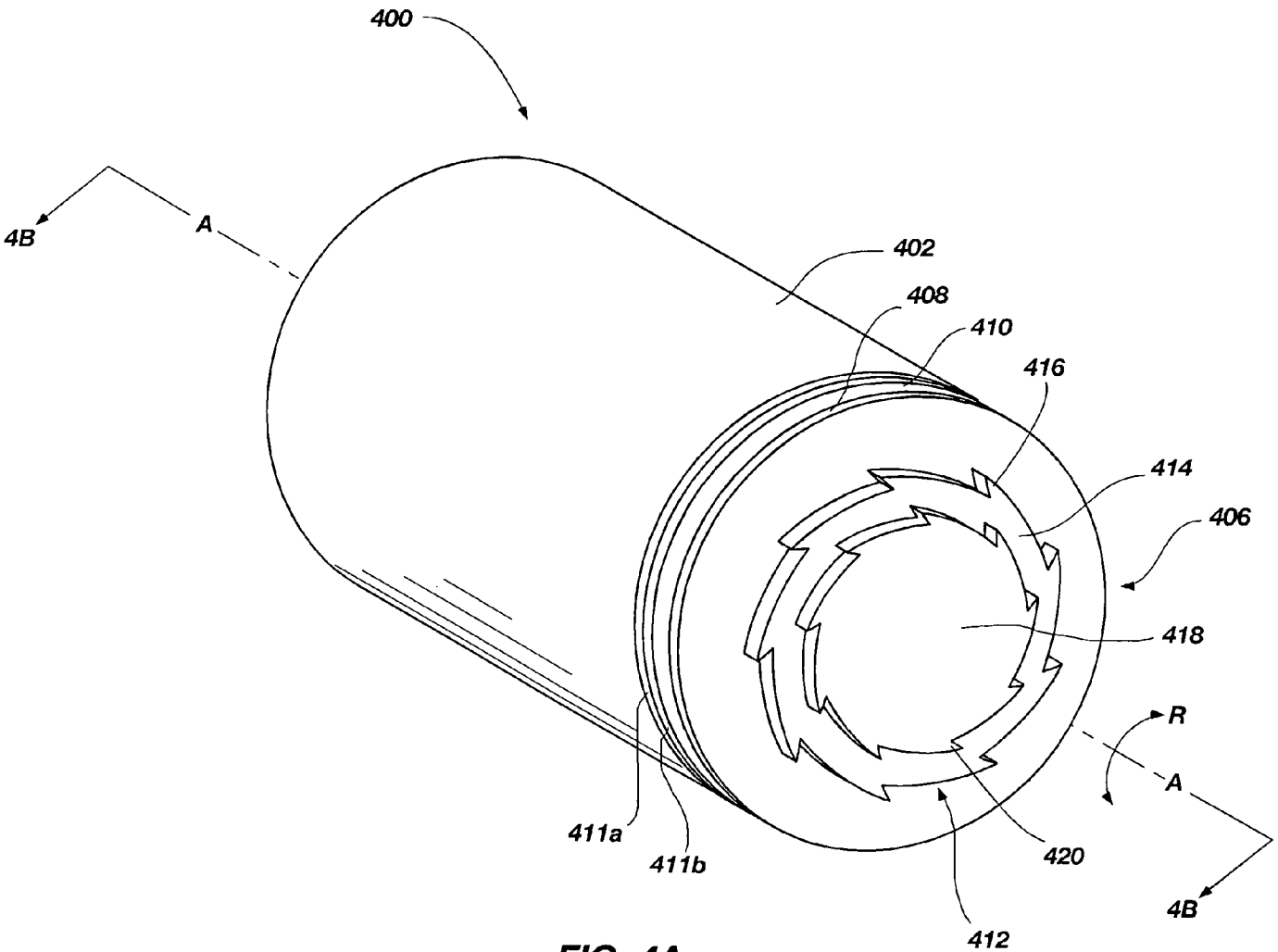
FIG. 4A is an isometric view of a cutter assembly including a cutting element comprising surface features configured to promote rotation thereof during drilling according to one embodiment of the present invention.

FIG. 4A is an isometric view of a cutter assembly 400 including a cutting element comprising surface features configured to promote rotation thereof during drilling according to one embodiment of the present invention. The cutter assembly 400 comprises a housing 402 including a recess 404 (FIG. 4B) formed therein. The housing 402 may be made from a wear-resistant material, such as a tool steel, bearing steel, a cemented-carbide material (e.g., cobalt-cemented tungsten carbide), or another suitable material. A cutting element 406 is received within the recess 404 (FIG. 4B) and rotatable in direction R about a rotation axis A of the cutting element 406. The cutting element 406 includes a superabrasive table 408 bonded to a substrate 410. As illustrated in FIG. 4A, the cutter assembly 400 may include bearing elements 411*a* and 411*b* disposed between the housing 402 and the substrate 410. As used herein, the term "superabrasive table" means a material that exhibits a hardness exceeding a hardness of tungsten carbide. The superabrasive table 408 may comprise polycrystalline diamond, a diamond-silicon carbide composite, polycrystalline cubic boron nitride, polycrystalline cubic boron nitride and polycrystalline diamond, or any other suitable superabrasive material. The substrate 410 may comprise cobalt-cemented tungsten carbide or another suitable material. For example, other materials that may be used for the substrate 410 include, without limitation, cemented carbides, such as titanium carbide, niobium carbide, tantalum carbide, vanadium carbide, or combinations thereof cemented with iron, nickel, or alloys thereof.

In certain embodiments of the present invention, the superabrasive table 408 may include a solvent catalyst selected to promote growth of precursor superabrasive particles of the superabrasive table 408. For example, cobalt may be swept in from the substrate 410 when the substrate 410 comprises a cobalt-cemented tungsten carbide substrate to promote growth of diamond particles. In certain embodiments of the present invention, a portion of solvent catalyst present in the superabrasive table 408 may be removed to a selected depth within the superabrasive table 408 using a leaching process. The substrate 410 and the superabrasive table 408 may be bonded to each other during a high-pressure, high-temperature ("HPHT") sintering process, or in a subsequent HPHT bonding process or brazing process after the superabrasive table 408 is formed.

Still referring to FIG. 4A, the superabrasive table 408 comprises a cutting face 412 that includes a plurality of surface features. For example, the surface features may include at least one body that comprises a plurality of radially-extending and, in certain embodiments of the present invention, circumferentially-extending teeth. In the illustrated embodiment shown in FIG. 4A, the surface features includes a first body 414 that comprises a plurality of radially- and circumferentially-extending teeth 416 and a second body 418 that also comprises a plurality of radially- and circumferentially-extending teeth 420. The second body 418 may exhibit a generally lesser radial or lateral dimension than that of the first body 414. The surface features (i.e., the first body 414 and second body 418) are configured to promote rotation of the cutting element 406 about the rotation axis A within the recess 404 (FIG. 4B) when the cutting element 406 engages a subterranean formation during drilling operations. In another embodiment of the present invention, the teeth 416 and 420 may be eliminated so that the surface features comprise first and second stacked superabrasive disks, with the second disk exhibiting a smaller diameter than that of the first disk. As discussed above, in certain embodiments of the present invention, the teeth 416 and 420 may not extend substantially circumferentially so that the first body 414 and the second body 418 each exhibit a star-shaped geometry. As a result of the cutting element 406 rotating during drilling operations, a cutting edge of the superabrasive table 408 may more uniformly wear.

The surface features may be machined after HPHT sintering superabrasive particles to form a superabrasive table. For example, electro-discharge machining ("EDM") may be used to define the surface features. In another embodiment of the present invention, the canister used to hold the superabrasive particles during the HPHT sintering process may be selectively shaped so that the HPHT-processed superabrasive table 408 exhibits the surface features illustrated in FIG. 4A.

Figure 4B:
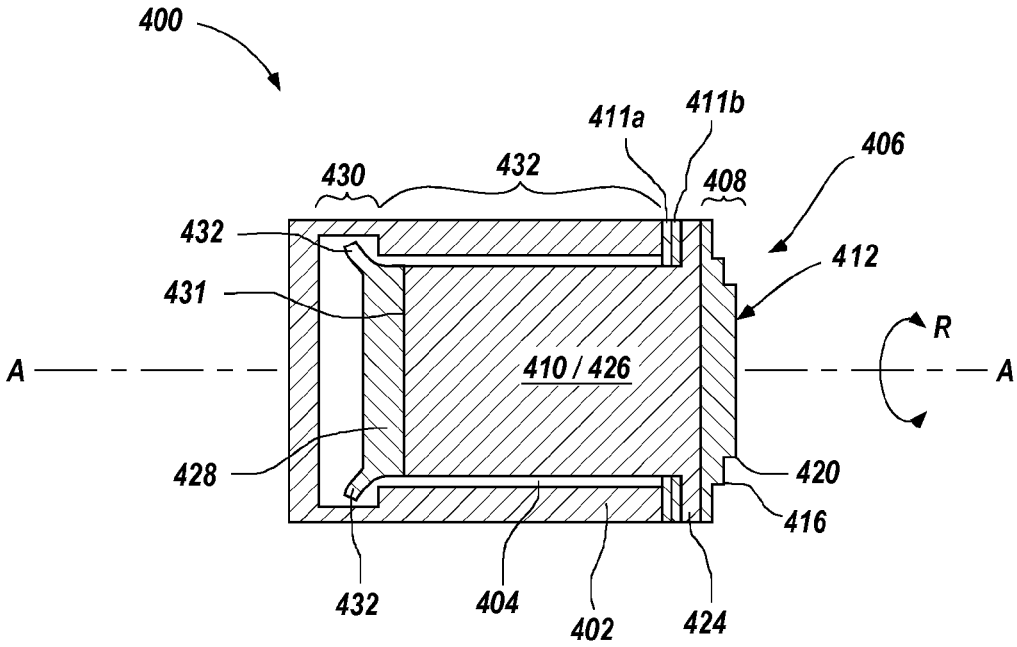
FIG. 4B is a cross-sectional view of the cutter assembly shown in FIG. 4A taken along line 4B-4B.

The structure of the cutting element 406 is illustrated in FIG. 4B, which is a cross-sectional view taken along line 4B-4B of the cutter assembly 400 shown in FIG. 4A. Referring to FIG. 4B, the substrate 410 includes a backing portion 424 bonded to the superabrasive table 408 and a shaft portion 426 extending from the backing portion 424. In one embodiment of the present invention, the backing portion 424 and shaft portion 426 may be integrally formed from a unitary piece of substrate material by machining the substrate material to reduce the radial dimension and, thus, form the shaft portion 426. In another embodiment of the present invention, the shaft portion 426 may comprise a metallic material, such as a tool steel or bearing steel that is joined to the backing portion 424 using a brazing process or another suitable joining technique. Each bearing element 411*a* and 411*b* exhibits a generally annular geometry that includes an aperture (not shown) through which the shaft portion 426 extends. One side of the bearing element 411*b* abuts the backing portion 424 and an opposing side of the bearing element 411*a* abuts or is bonded to an end of the housing 402. The bearing elements 411*a* and 411*b* may be made from the same or similar materials as the superabrasive table 408 to provide a superhard bearing surface (i.e., a bearing surface exhibiting a hardness greater than that of tungsten carbide). The bearing elements 411*a* and 411*b* may prevent braze alloy from accessing the recess 404 when the housing 402 is brazed to a bit body of a drill bit because commonly used braze alloys do not generally wet the superhard materials that may comprise each bearing element 411*a* and 411*b*.

The bearing elements 411*a* and 411*b* may also help reduce wear on the housing 402 and the backing portion 424 of the substrate 410 that can occur due to the cutting element 406 rotating within the housing 402 and bearing against a portion of the housing 402. The bearing element 411*b* may generally rotate with the cutting element 406 and the bearing element 411*a* may be bonded to or otherwise remain generally stationary with respect to the housing 402 due to frictional forces between the adjacent bearing elements 411*a* and 411*b* being less than frictional forces between the bearing element 411*a* and the housing 402 and the bearing element 411*b* and the substrate 410. In some embodiments of the present invention, the bearing element 411*b* and the backing portion 424 may be eliminated so that only a shaft portion projects from the superabrasive table 408. In such an embodiment, a back surface of the superabrasive table 408 may function as a bearing surface in a manner similar to the bearing element 411*b*. In other embodiments of the present invention, the bearing element 411*a* may be HPHT bonded to the housing 402. For example, the housing 402 and the bearing element 411*a* may be machined from a PDC, with the bearing element 411*a* being machined from the PCD table of the PDC.

With continued reference to FIG. 4B, the substrate 410 further includes a retention element 428 attached to an end 431 of the shaft portion 426. The retention element 428 includes a flared portion 432 (e.g., a peripherally-extending flared portion) configured to restrict displacement of the cutting element 406 along the rotation axis A so that the cutting element 406 is retained within the recess 404 of the housing 402. The retention element 410 may be made from a material that exhibits a relatively higher ductility (i.e., lower yield stress) than that of the shaft portion 426, such as a metal or alloy (e.g., a commercially-pure refractory metal or a refractory-metal alloy). The retention element 428 may be secured to the end 431 of the shaft portion 426 by brazing, an HPHT bonding process, or another suitable joining technique. In one embodiment of the present invention, a precursor retention element may HPHT processed with the substrate material and deformed, after HPHT processing, to form the flared portion 432 of the retention element 428.

Figure 4C:
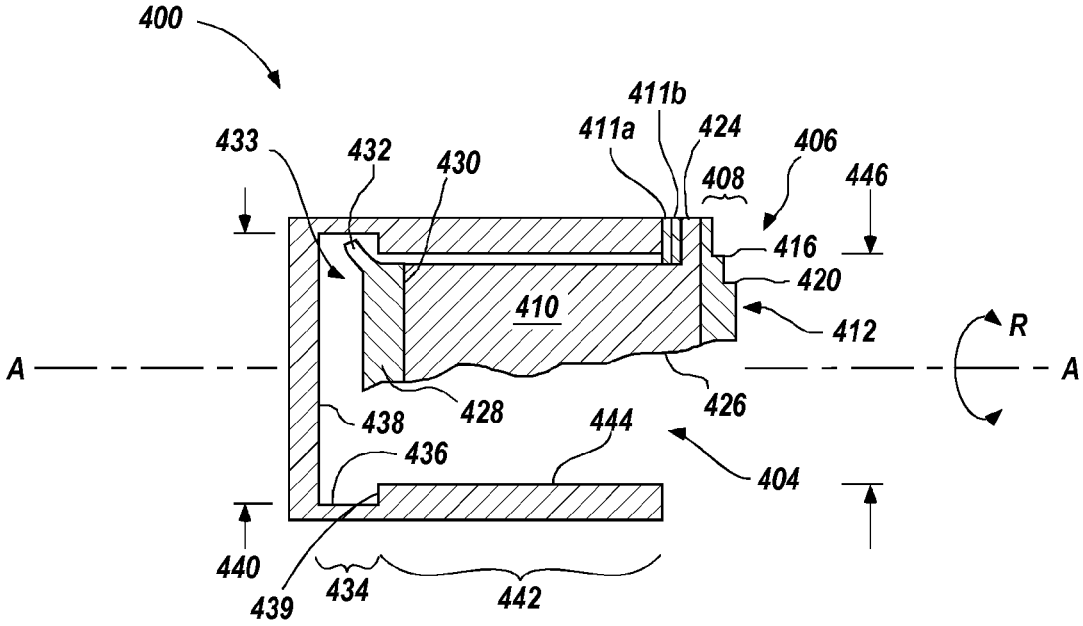
FIG. 4C is a cross-sectional view of the cutter assembly shown in FIG. 4A taken along 4B-4B, with a portion of the cutting element removed to more clearly illustrate the internal geometry of the housing.

FIG. 4C is a cross-sectional view taken along line 4B-4B of the cutter assembly 400 shown in FIG. 4A, with a portion of the cutting element 406 removed to more clearly show the geometry of the recess 404 and the manner in which the flared portion 432 of the retention element 428 restricts axial displacement of the cutting element 406. The recess 404 includes an enlarged-diameter portion 434 defined by an interior sidewall surface 436, a base surface 438, and an interference surface 439. The enlarged-diameter portion 434 exhibits a first diameter 440. The recess 404 further includes a reduced-diameter portion 442 defined by an interior sidewall surface 444. The reduced-diameter portion 442 exhibits a second diameter 446 that is less than that of the first diameter 440. At least the flared portion 432 of the retention element 428 resides within the enlarged-diameter portion 434 of the recess 404. The flared portion 432 extends radially outwardly so that an end 433 of the retention element 428 that includes the flared portion 432 exhibits a diameter or lateral dimension that is greater than that of the second diameter 446 of the reduced-diameter portion 442, but may be less than that of the first diameter 440 to allow for rotation of the flared portion 432 within the enlarged-diameter portion 434. Accordingly, the flared portion 432 limits axial displacement of the cutting element 406 along the rotation axis A and retains the cutting element 406 generally within the housing 402 due to physical interference between the interference surface 439 and the flared portion 432 when the cutting element 406 is displaced a sufficient distance along the rotation axis A.

Figure 4D:
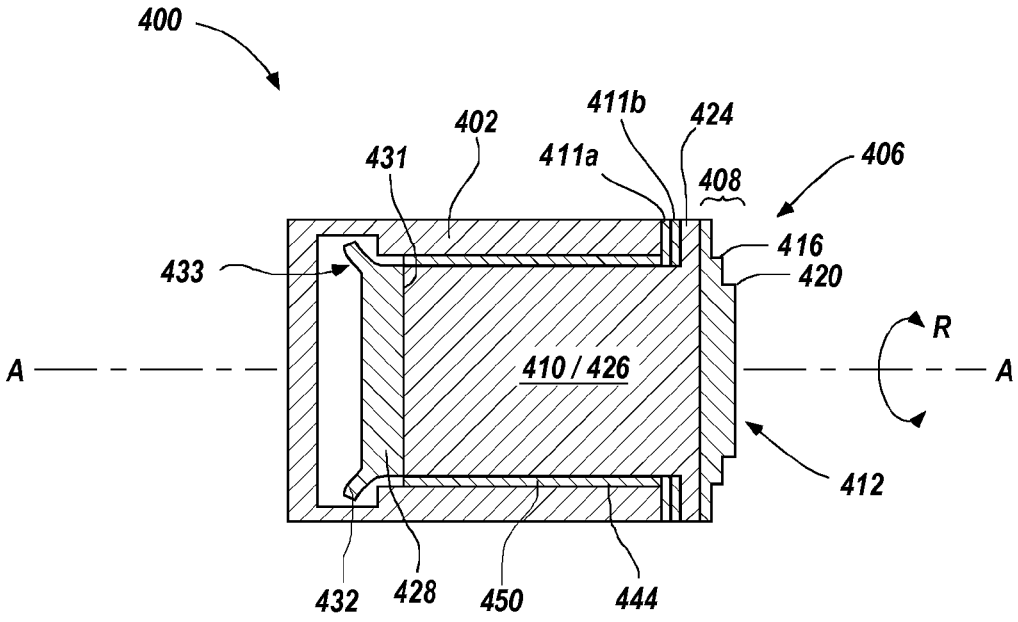
FIG. 4D is a cross-sectional view of the cutter assembly shown in FIG. 4B including at least one bearing element disposed within the housing between an interior surface of the housing and a shaft portion of the cutting element according to another embodiment of the present invention.

FIG. 4D is a cross-sectional view of the cutter assembly 400 shown in FIG. 4B including at least one bearing element 450 disposed within the housing 402 between the interior sidewall surface 444 of the housing 402 and the shaft portion 426 of the cutting element 406 according to another embodiment of the present invention. The at least one bearing element 450 may comprise a sleeve made from a superhard material, such as any of the materials that may be used for the superabrasive table 408. When the at least one bearing element 450 is configured as a superhard sleeve, the retention element 428 and the shaft portion 426 may be inserted into the superhard sleeve, prior to forming the flared portion 432 of the retention element 428, so that the superhard sleeve receives at least a portion of the shaft portion 426 as illustrated. In certain embodiments of the present invention, the sleeve may further receive and extend about a portion of the retention element 428 adjacent to and proximate to the end 431 of the shaft portion 426. When the cutting element 406 carrying the at least one bearing element 450 is assembled with the housing 402, the at least one bearing element 450 may bear against the interior sidewall surface 444 that defines the reduced-diameter portion 442 (FIG. 4C).

Figure 4E:
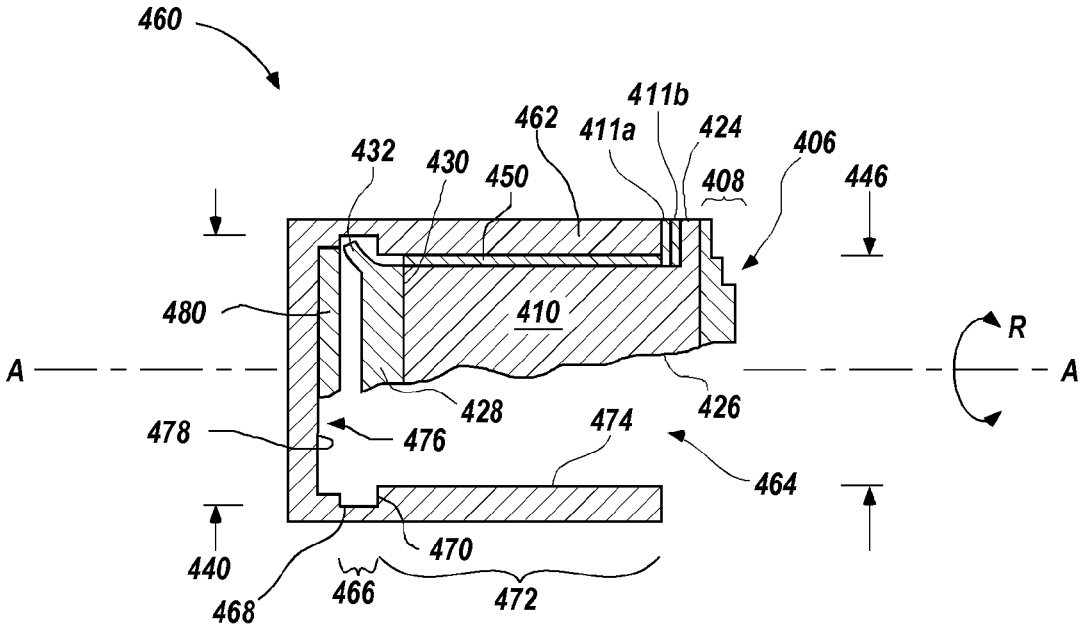
FIG. 4E is a cross-sectional view of a cutter assembly including a bearing element disposed adjacent to the flared portion of the retention element, with a portion of the cutting element and the bearing element removed to more clearly illustrate the internal geometry of the housing, according to yet another embodiment of the present invention.

FIG. 4E is a cross-sectional view of a cutter assembly 460, with a portion of the cutting element 406 removed for clarity. The cutter assembly 460 is structurally similar to cutter assembly 400 of FIGS. 4A-4D. Therefore, in the interest of brevity, components in both of the cutter assemblies 400 and 460 that are identical to each other have been provided with the same reference numerals, and an explanation of their structure and function will not be repeated unless the components or features function differently in the cutter assemblies 400 and 460. The cutter assembly 460 comprises a housing 462 including a recess 464 formed therein that receives the cutting element 406 in a manner similar to the cutter assembly 400. The housing 462 may be made from the same or similar materials as the housing 402 shown in FIGS. 4A-4D. Similar to the recess 404 of the housing 402 (FIG. 4C), the recess 464 of the housing 462 includes an enlarged-diameter portion 466 partially defined by an interior sidewall surface 468 and an interference surface 470, and a reduced-diameter portion 472 defined by an interior sidewall surface 474. The enlarged-diameter portion 466 is sized and configured to receive the retention element 428 including the flared portion 432 thereof. As illustrated in FIG. 4E, the bearing element 450 may be disposed between the interior sidewall surface 474 and the shaft portion 426 of the cutting element 406. Additionally, the housing 462 includes a recess 476 partially defined by a base surface 478. The recess 476 receives a bearing element 480 that may be made from the same superhard materials as the bearing element 450. The bearing element 480 may alleviate wear that would ordinarily be caused by the flared portion 432 bearing against the base surface 478 during use.

Figure 5:
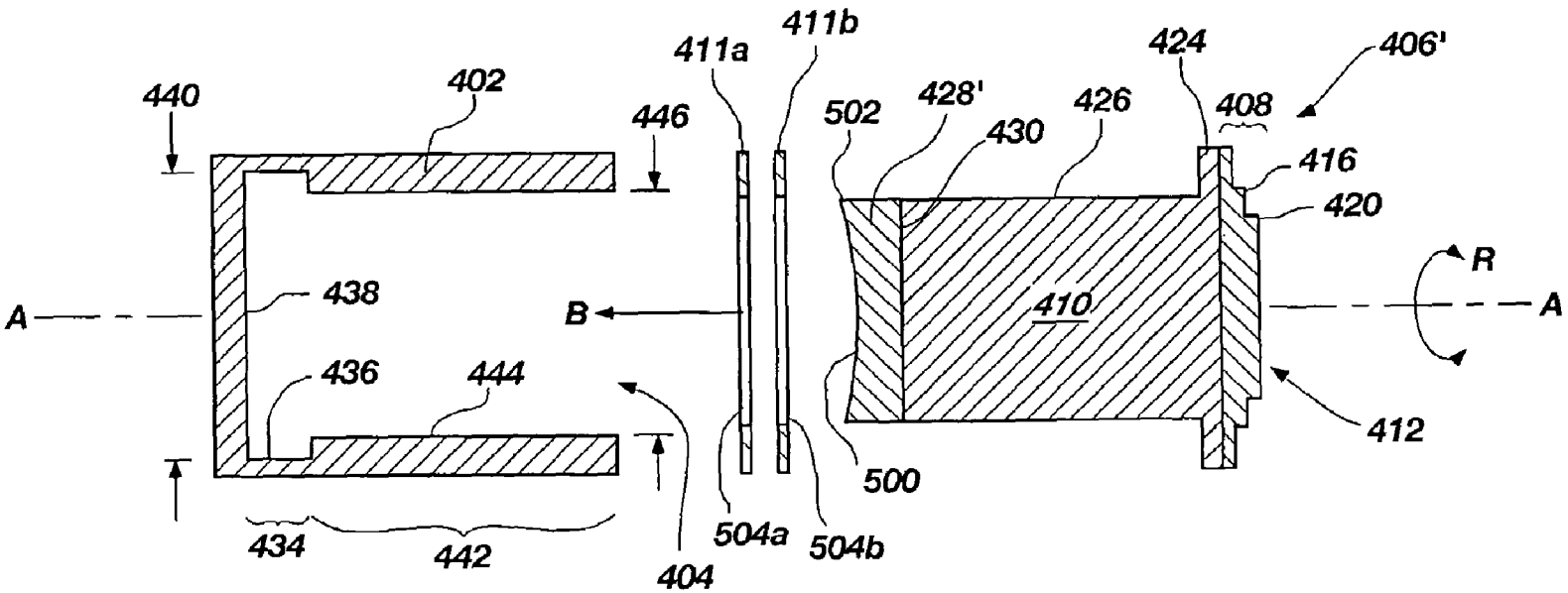
FIG. 5 is an exploded cross-sectional view of the cutter assembly shown in FIG. 4B prior to insertion of the cutting element through the bearing element and into the housing illustrating one embodiment of a method fabricating the cutter assembly according to the present invention.

FIG. 5 is an exploded cross-sectional view of the cutter assembly shown in FIG. 4B prior to insertion of the cutting element through the bearing element and into the housing that illustrates a method of fabricating the cutter assembly 400 according one embodiment of the present invention. Referring to FIG. 5, a precursor cutting element 406' includes the superabrasive table 408 bonded to the substrate 410. Attached to the end 431 of the shaft portion 426 of the substrate 410 is a precursor retention element 428' that includes a concavely-curved surface 500 (e.g., a generally-spherical-concave surface) that comprises an edge region 502. The precursor retention element 428' may be inserted through a through hole 504*b* formed in the bearing element 411*b*, a through hole 504*a* formed in the bearing element 411*a*, and into the recess 404 of the housing 402 generally in a direction B. The precursor retention element 428' is inserted into the recess 404 a sufficient extent so that the edge region 502 is compressed against the interior base surface 438. Compressing the edge region 502 and the interior base surface 438 against each other may deform and cause at least a portion of the edge region 502 to flare radially outwardly to form the flared portion 432 illustrated in the retention element 428 best shown in FIG. 4B. It should be noted that when a bearing element (e.g., a superhard bearing sleeve) is disposed between the interior sidewall surface 444 and the shaft portion 426 of the substrate 410, the bearing element may be inserted into the recess 404 of the housing 402 prior to insertion of the precursor cutting element 406' or may be assembled with the precursor cutting element 406' prior to insertion into the housing 402 and forming the flared portion 432 of the retention element 428.

In another embodiment of the present invention, a housing of a cutter assembly may include first and second halves, which, when assembled, are structured similarly to the housing 402 shown in FIGS. 4A-4E. A cutting element that includes a pre-deformed or pre-machined retention element similarly structured to the cutting element 406 may be inserted into the first half of the housing. Then, the second half of the housing may be assembled with the first half and secured thereto by brazing, using one or more fasteners (e.g., one or more set screws), or another suitable technique capable of retaining the cutting element generally within the housing.

Figure 6:
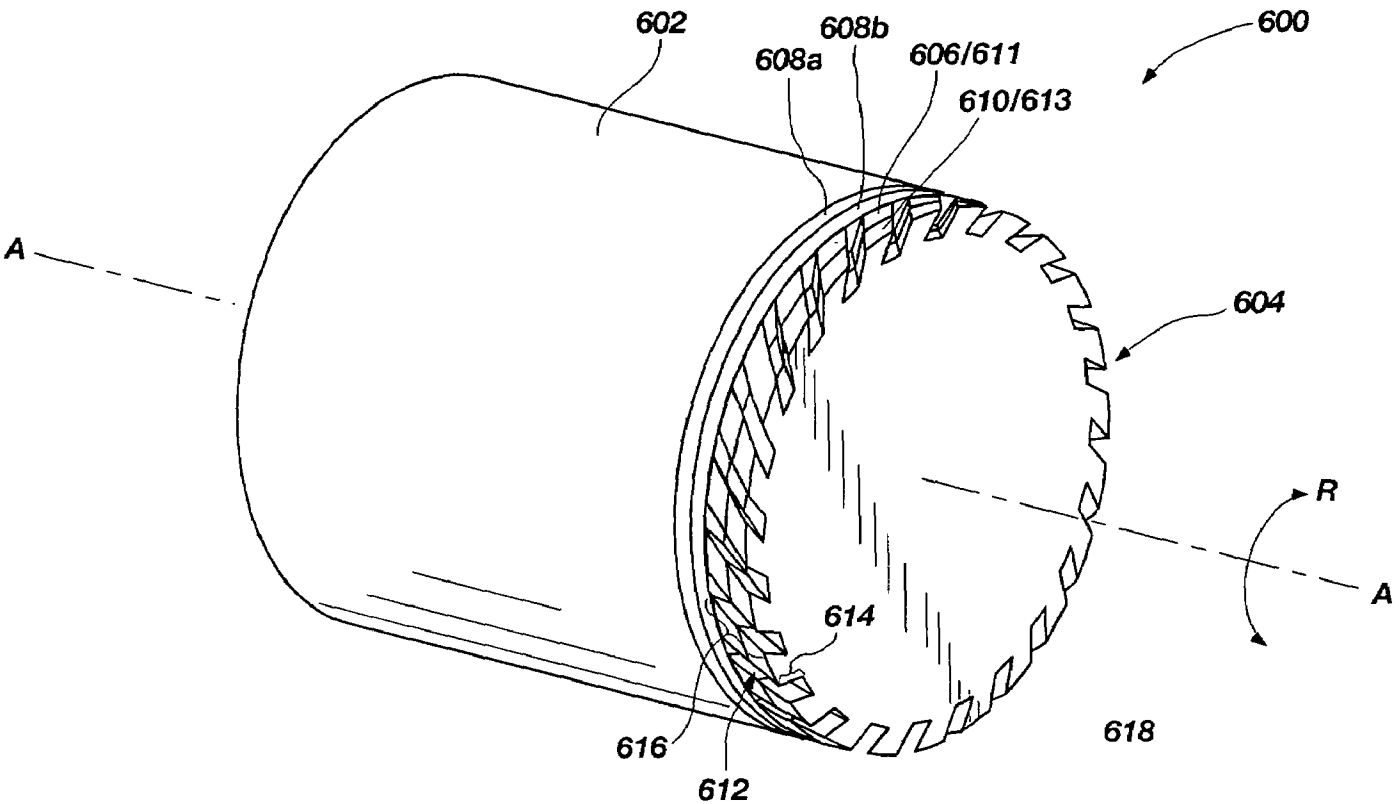
FIG. 6 is an isometric view of a cutter assembly including a cutting element comprising circumferentially-spaced grooves configured to promote rotation of the cutting element during drilling according to another embodiment of the present invention.

The configuration of the surface features of the superabrasive table 408 shown in FIGS. 4A-4E merely represents one embodiment of the present invention. A number of different configurations for surface features may be employed that depart from the illustrated configuration of the surface features shown in the superabrasive table 408 of FIGS. 4A-4E. For example, FIG. 6 is an isometric view of a cutter assembly 600 according to another embodiment of the present invention. The cutter assembly 600 comprises a housing 602 including a recess (not shown) formed therein that receives a cutting element 604. As with the cutter assembly 400, the cutting element 604 is retained within the housing 602 and rotatable about a rotation axis A in a direction R. The cutting element 604 includes a substrate 606 (only a backing portion of the substrate 606 shown) that may be configured the same or similar as the substrate 410 shown in FIG. 4A and may further include a suitable retention mechanism attached thereto for retaining the cutting element 604 in the housing 602, such as the retention element 428 shown in FIG. 4B. In certain embodiments of the present invention, bearing elements 608*a* and 608*b* may be disposed between an end portion of the housing 602 and the substrate 606.

Still referring to FIG. 6, a superabrasive table 610 may be bonded to the backing portion of the substrate 606. A plurality of surface features may be formed in the substrate 606 and the superabrasive table 610. The plurality of surface features shown in FIG. 6 comprise a plurality of circumferentially- and radially-inwardly-extending slots 612 that extend through respective circumferential surfaces 611 and 613 of the substrate 606 and the superabrasive table 610. The slots 612 may be machined into the substrate 606 and the superabrasive table 610 using, for example, EDM. A section 614 of each of the slots 612 may extend circumferentially and radially-inwardly within a cutting face 618 of the superabrasive table 610 to a greater depth than a main section 616 of each of the slots 612. In one embodiment of the present invention, each of the slots 612 may extend along the circumferential surfaces 611 and 613 in a generally helical path.

In certain embodiments of the present invention, the slots 612 may be formed only in the superabrasive table 610 and not in the backing portion of the substrate 606. In yet another embodiment of the present invention, the slots 612 may be formed only in the backing portion of the substrate 606 and not in the superabrasive table 610. During drilling operations, the slots 612 promote rotation of the cutting element 604 within the housing 602.

Figure 7:
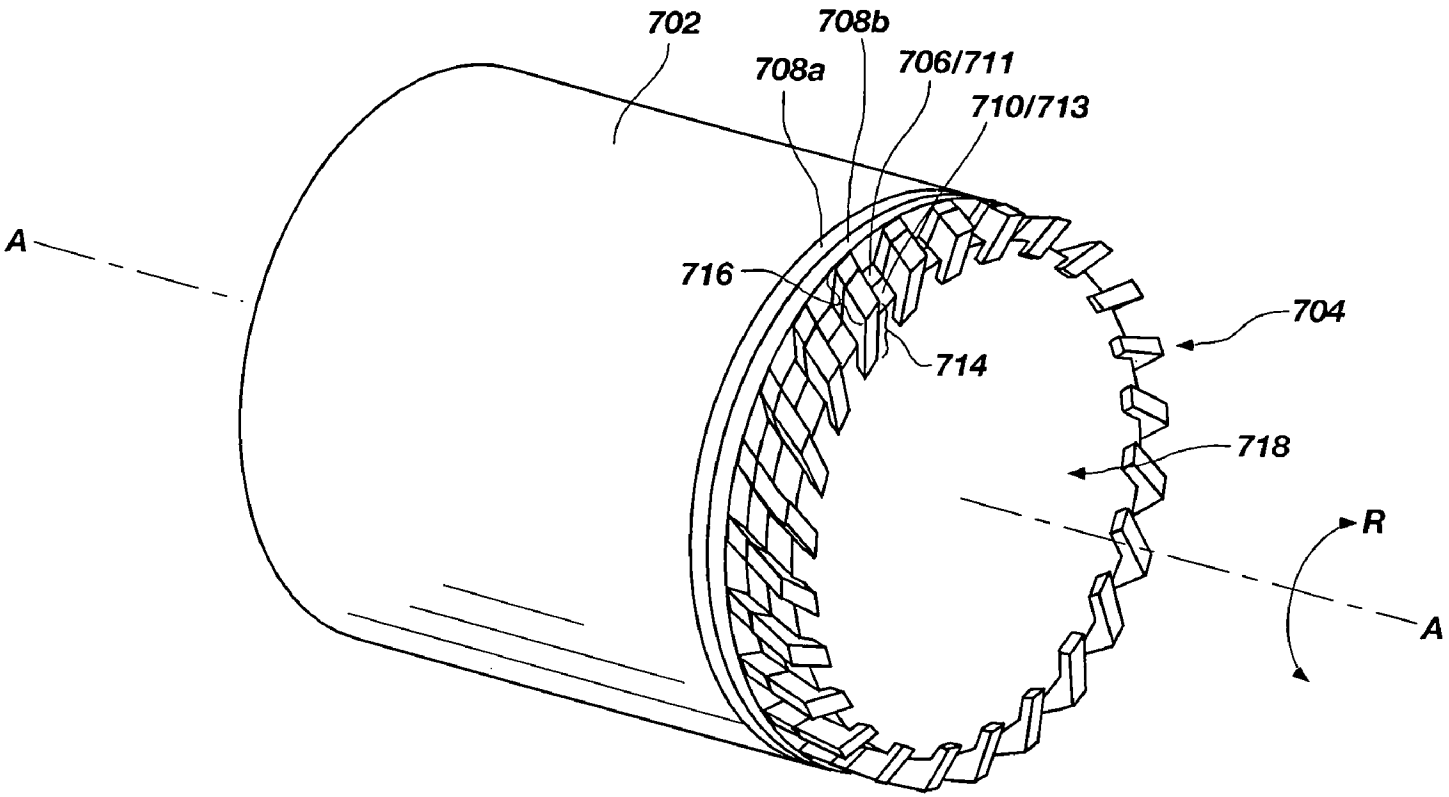
FIG. 7 is an isometric view of a cutter assembly including a cutting element comprising circumferentially-spaced projections configured to promote rotation of the cutting element during drilling according to yet another embodiment of the present invention.

FIG. 7 is an isometric view of a cutter assembly 700 according to yet another embodiment of the present invention. The cutter assembly 700 comprises a housing 702 including a recess (not shown) formed therein that receives a cutting element 704. As with the cutter assembly 400, the cutting element 704 is retained within the housing 702 and rotatable about a rotation axis A in a direction R. The cutting element 704 includes a substrate 706 (only a backing portion of the substrate 706 shown) that may be configured the same or similar as the substrate 410 shown in FIG. 4A and may further include a suitable retention mechanism attached thereto for retaining the cutting element 704 in the housing 702, such as the retention element 428 shown in FIG. 4B. In certain embodiments of the present invention, bearing elements 708*a* and 708*b* may be disposed between an end portion of the housing 702 and the substrate 706.

Still referring to FIG. 7, a superabrasive table 710 may be bonded to the backing portion of the substrate 706. The substrate 706 and the superabrasive table 710 include a plurality of surface features. The surface features comprise a plurality of circumferentially- and radially-extending projections 712 formed along a circumferential region of the substrate 706 and the superabrasive table 710. The projections 712 may be formed by selectively removing portions of the substrate 706 and the superabrasive table 710 using a machining process, such as EDM. A cutting face 718 of the superabrasive table 710 includes a section 714 of each of the projections 712 that may project outward and extend radially inwardly. A section 716 of each of the projections 712 projects radially outwardly from respective circumferential surfaces 711 and 713 of the substrate 706 and the superabrasive table 710. In one embodiment of the present invention, each of the projections 712 may extend along the circumferential surfaces 711 and 713 in a generally helical path.

In certain embodiments of the present invention, only the superabrasive table 710 may comprise the projections 712. In yet another embodiment of the present invention, only the backing portion of the substrate 706 may comprise the projections 712. During drilling operations, the projections 712 promote rotation of the cutting element 704 within the housing 702 in manner similar to slots 612 shown in FIG. 6.

Figure 8A:
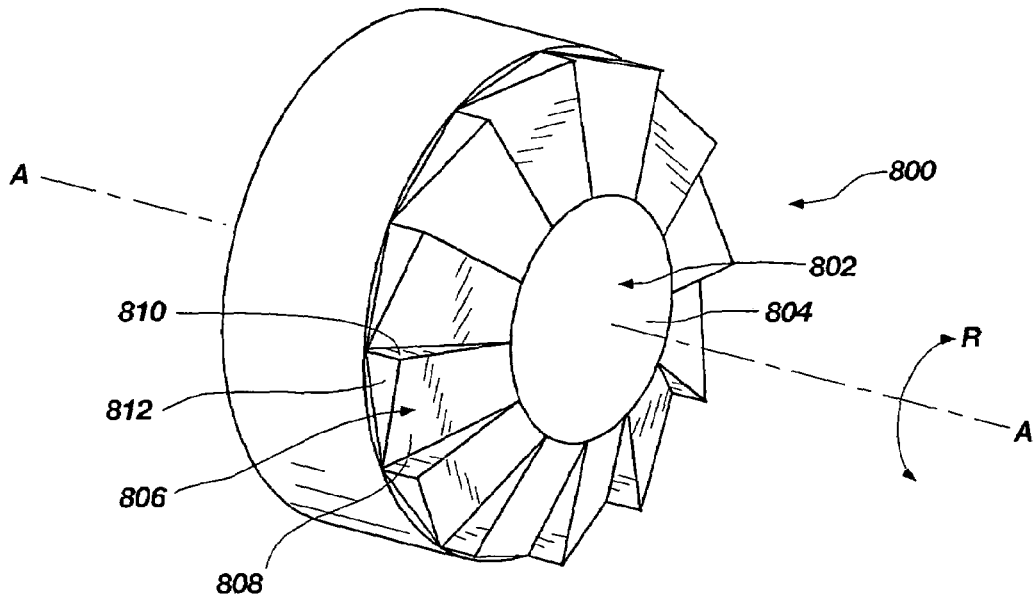
FIG. 8A is an isometric view of a superabrasive table including a plurality of blades configured to promote rotation cutting element during drilling according to yet another embodiment of the present invention.
Figure 8B:
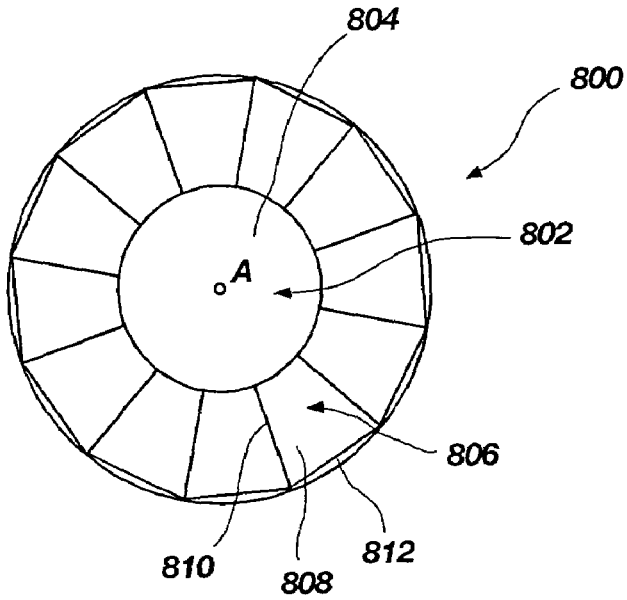
FIG. 8B is a top elevation view of the superabrasive table shown in FIG. 8A.
Figure 8C:
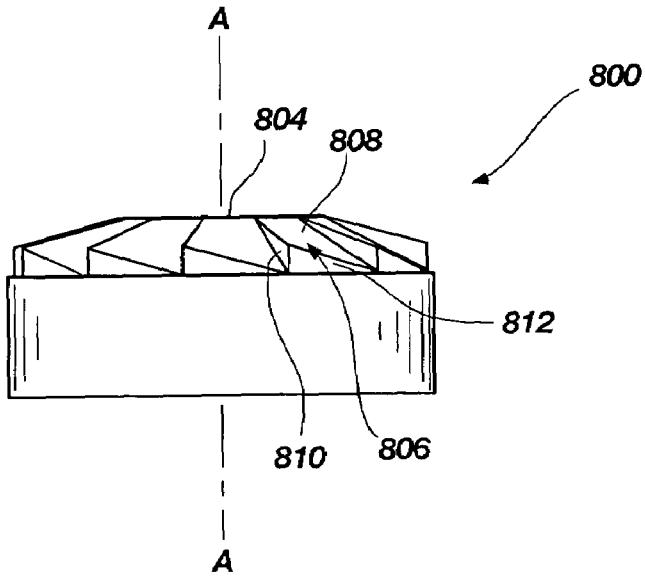
FIG. 8C is a side elevation view of the superabrasive table shown in FIG. 8A.

FIGS. 8A-8C are isometric, top elevation, and side elevation views, respectively, of a superabrasive table 800 including a cutting face comprising surface features configured to promote rotation of a cutting element according to yet another embodiment of the present invention. The superabrasive table 800 comprises a cutting face 802 including a central region 804 generally centered about a rotation axis A that includes a generally planar surface. The surface features of the cutting face 802 includes a plurality of blades 806 that are circumferentially distributed about a rotation axis A and extend radially outward from the central region 804. Each of the blades 806 comprises a cutting surface 808 exhibiting a height that may gradually decrease with increasing radial distance from the central region 804, and sidewall surfaces 810 and 812. The height of each of the blades 806 may further gradually decrease in a circumferential direction away from the sidewall surface 810. As with the previously described cutter assembly embodiments, each of the blades 806 is configured to promote rotation of a cutting element comprising the superabrasive table 800 when the superabrasive table 800 engages a subterranean formation during drilling operations.

Figure 9:
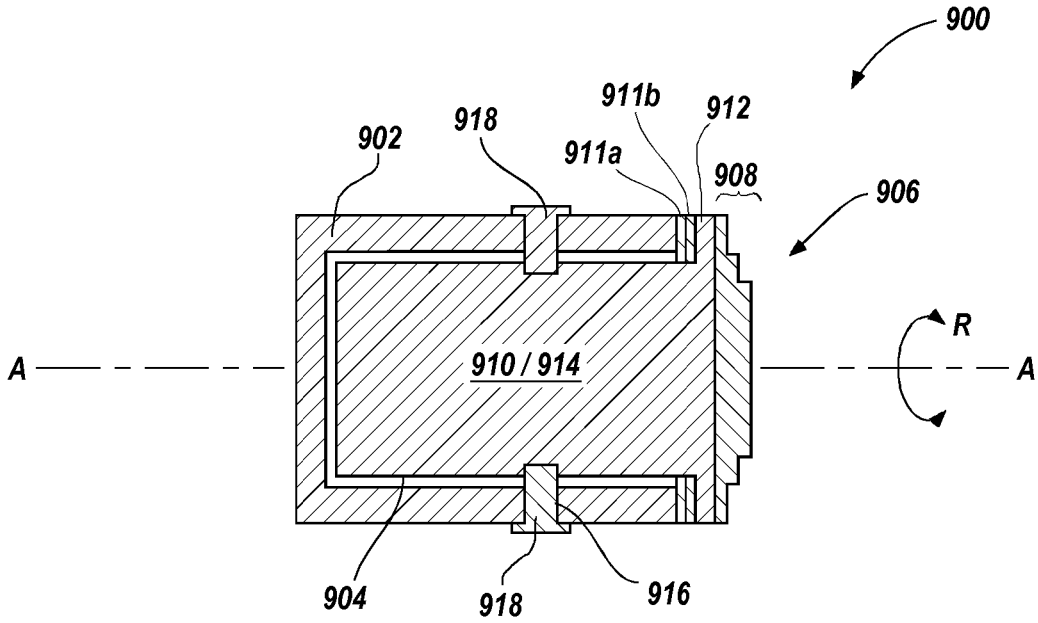
FIG. 9 is a cross-sectional view of a cutter assembly including at least one retention element extending through a sidewall of a housing and into a slot formed in the cutting element according to one embodiment of the present invention.
Figure 10:
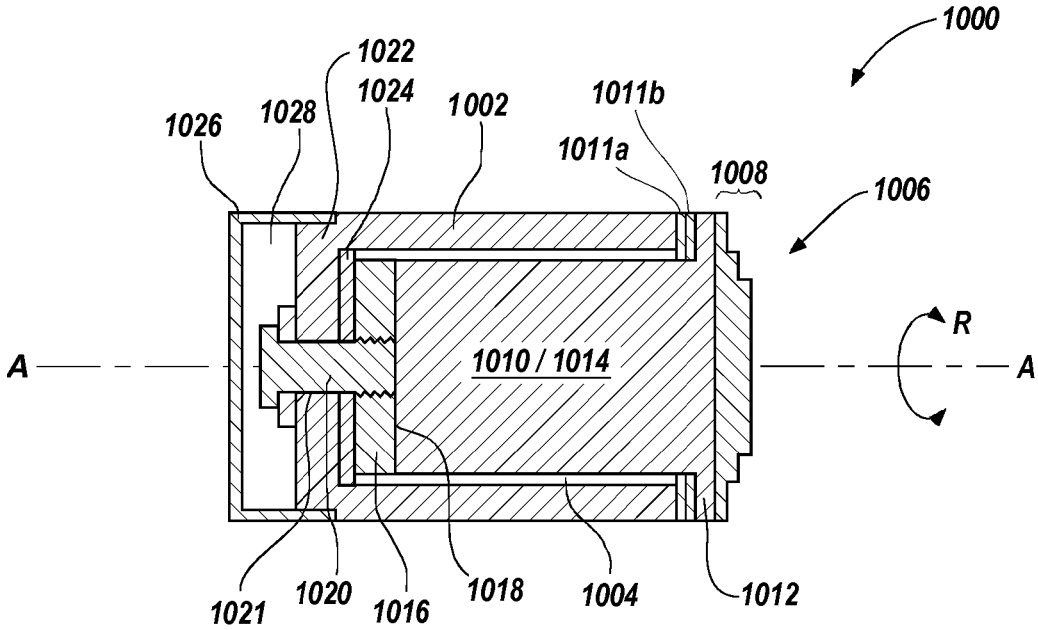
FIG. 10 is a cross-sectional view of a cutter assembly including a retention element extending through a base of a housing and coupled to the cutting element received by the housing according to one embodiment of the present invention.

There are many different techniques for retaining a cutting element generally within a housing of a cutter assembly that depart from the illustrated retention element 428 shown in FIG. 4B. FIGS. 9 and 10 illustrate different embodiments for retaining a cutting element generally within a housing of a cutter assembly. FIG. 9 is a cross-sectional view of a cutter assembly 900 according to yet another embodiment of the present invention. The cutter assembly 900 comprises a housing 902 that includes a recess 904 formed therein. A cutting element 906 is received by and rotatable within the recess 904 about a rotation axis A in a direction R. The cutting element 906 may include a superabrasive table 908 that may be configured the same or similar to the superabrasive table 408 shown in FIGS. 4A-4E. However, other configurations for the superabrasive table 908 may be used, such as the configuration of the superabrasive tables 610 and 710 shown in FIGS. 6 and 7.

The cutting element 906 further includes a substrate 910 that may be made from the same materials used for the substrate 410 shown in FIG. 4B. The substrate 910 includes a backing portion 912 bonded to the superabrasive table 908 and a shaft portion 914 extending from the backing portion 912. In certain embodiments of the present invention, bearing elements 911*a* and 911*b* may extend about the shaft portion 914 and is positioned between an end of the housing 902 and the backing portion 912. The shaft portion 914 includes a circumferentially-disposed slot 916. A plurality of fastening elements 918 may be inserted through an opening formed in the housing 902 and extend radially inwardly. Each of the fastening elements 918 may be secured to the housing 902 and a portion thereof received by the circumferentially-disposed slot 916. For example, each of the fastening elements 918 may be a screw made from polycrystalline diamond or a cemented-carbide material that threadly attaches to the housing 902. Although two of the fastening elements 918 are used to retain the cutting element 906 generally within the housing 902, more than or less than two of the fastening elements 918 may be employed. The fastening elements 918 may be structured to limit displacement of the cutting element 906 along the rotation axis A due to the fastening elements 918 physically interfering with the shaft portion 914 when the cutting element 906 is attempted to be displaced along the rotation axis A, while still allowing the shaft portion 914 to rotate in the direction R within the recess 904.

FIG. 10 is a cross-sectional view of a cutter assembly 1000 according to yet another embodiment of the present invention. The cutter assembly 1000 comprises a housing 1002 that includes a recess 1004 formed therein. A cutting element 1006 is received by and rotatable within the recess 1004 about a rotation axis A in a direction R. The cutting element 1006 may include a superabrasive table 1008 that may be configured the same or similar to the superabrasive table 408 shown in FIGS. 4A-4E. However, other configurations for the superabrasive table 1008 may be used, such as the configuration of the superabrasive tables 610 and 710 shown in FIGS. 6 and 7.

The cutting element 1006 further includes a substrate 1010 that may be made from the same materials used for the substrate 410 shown in FIG. 4B. The substrate 1010 includes a backing portion 1012 bonded to the superabrasive table 1008 and a shaft portion 1014 extending from the backing portion 1012. In certain embodiments of the present invention, bearing elements 1011*a* and 1011*b* extend about the shaft portion 1014 and is positioned between an end of the housing 1002 and the backing portion 1012.

Still referring to FIG. 10, a coupling member 1016 may be attached (e.g., HPHT bonded) to an end 1018 of the shaft portion 1014. A fastening element 1020 may be inserted through an opening 1021 formed in a base 1022 of the housing 1002 and extend into the recess 1004 along the rotation axis A. A bearing element 1024 (e.g., an annular disk formed of a superhard bearing material) may extend about the fastening element 1020 and may be positioned between the coupling member 1016 and the base 1022 of the housing 1002. In the illustrated embodiment, the fastening element 1020 may threadly couple to coupling member 1016 while further being configured, for example, with a generally smooth exterior surface to allow for rotation about the rotation axis A within the opening 1021. In other embodiments of the present invention, the fastening element 1020 may be press-fit into a recess formed in the coupling member 1016. Accordingly, the fastening element 1020 restricts displacement of the cutting element 1006 along the rotation axis A (e.g., parallel to the rotation axis A), while allowing for rotation about the rotation axis R of the shaft portion 1014 of the cutting element 1006 within the recess 1004 of the housing 1002. An end cap 1026 defining a receiving space 1028 may receive and attach to a portion of the housing 1002 to enclose an end of the fastening element 1020 and help prevent braze alloy from brazing the fastening element 1020 to the base 1022 of the housing and, thereby, inhibit or prevent rotation of the cutting element 1006 about the rotation axis R when the housing 1002 is brazed to a bit body of a drill bit.

Figure 11:
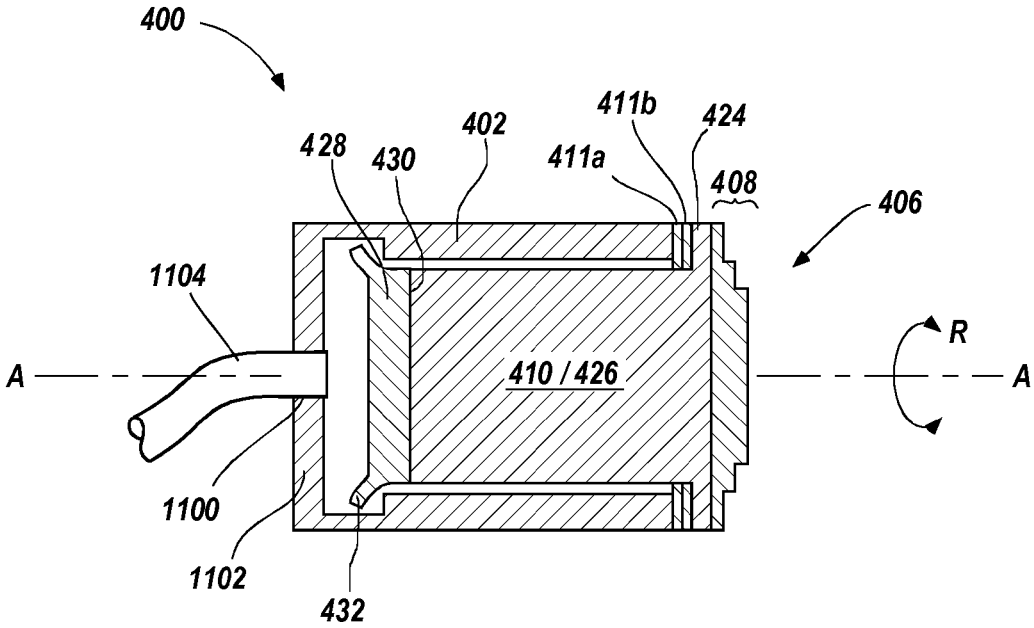
FIG. 11 is a schematic cross-sectional view of the cutter assembly shown in FIG. 4B including a fluid port formed in the base of the housing to allow for fluid to be injected into the housing according to another embodiment of the present invention.

In any of the previously described cutter assembly embodiments, lubricant may be injected into the recess in which a portion of the cutting element resides to allow for more friction-free rotation. For example, FIG. 11 is a cross-sectional view of the cutter assembly 400 shown in FIG. 4B modified to allow for injection of lubricant into the recess 404 of the housing 402. As shown in FIG. 11, an opening 1100 may be formed in a base 1102 of the housing 402. A fluid conduit 1104 is provided that is in fluid communication with the recess 404 of the housing 402. In the illustrated embodiment, the fluid conduit 1104 is inserted at least partially through the opening 1100. Lubricant may be injected through the fluid conduit 1104 and into the recess 404 to lubricate rotation of the cutting element 406 within the recess 404. It should be noted any of the previously described cutter assemblies may be modified to allow for injection of lubricant and the use of the cutter assembly 400 is merely one of many of such embodiments.

Figure 12:
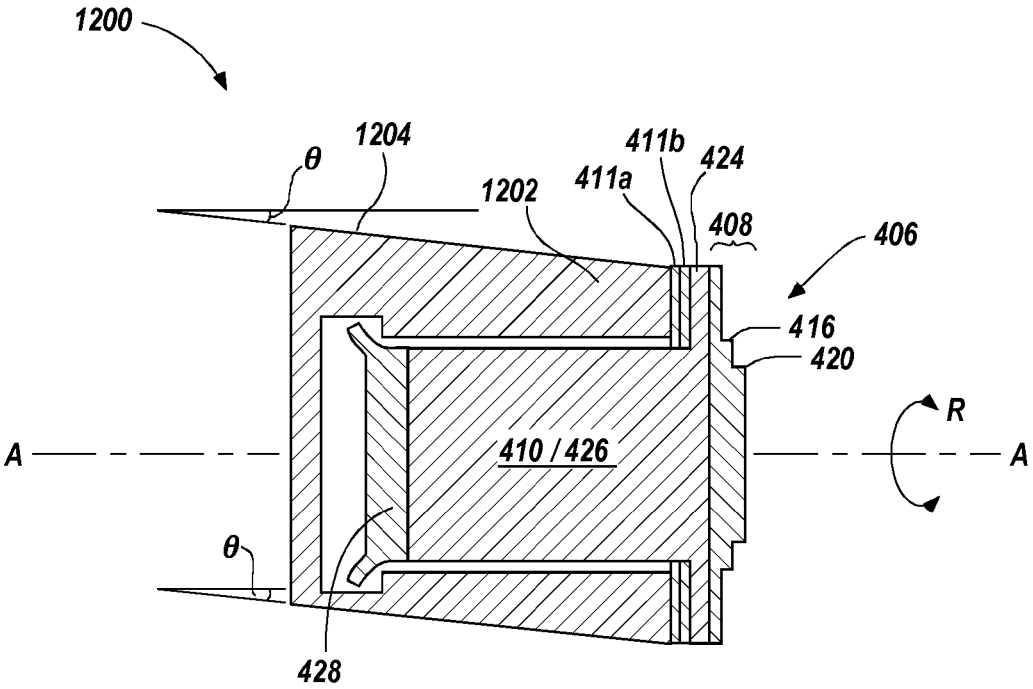
FIG. 12 is a cross-sectional view of a cutter assembly comprising a housing including an exterior surface oriented at a selected angle to impart a selected rake angle to a cutting element when mounted to a body of a drill bit according to one embodiment of the present invention.

The housing of any of the disclosed cutter assembly embodiments may exhibit an exterior surface oriented at a selected angle relative to a rotation axis of a cutting element to impart a selected side rake and/or back rake angle when the cutter assembly is mounted to a bit body of a drill bit. For example, FIG. 12 is a cross-sectional view of a cutter assembly 1200 that provides a selected rake angle to a cutter element according to one embodiment of the present invention. The cutter assembly 1200 is structurally similar to the cutter assembly 400 shown in FIG. 4B. Therefore, in the interest of brevity, components in both of the cutter assemblies 400 and 1200 that are identical to each other have been provided with the same reference numerals, and an explanation of their structure and function will not be repeated unless the components or features function differently in the cutter assemblies 400 and 1200.

Figure 1:
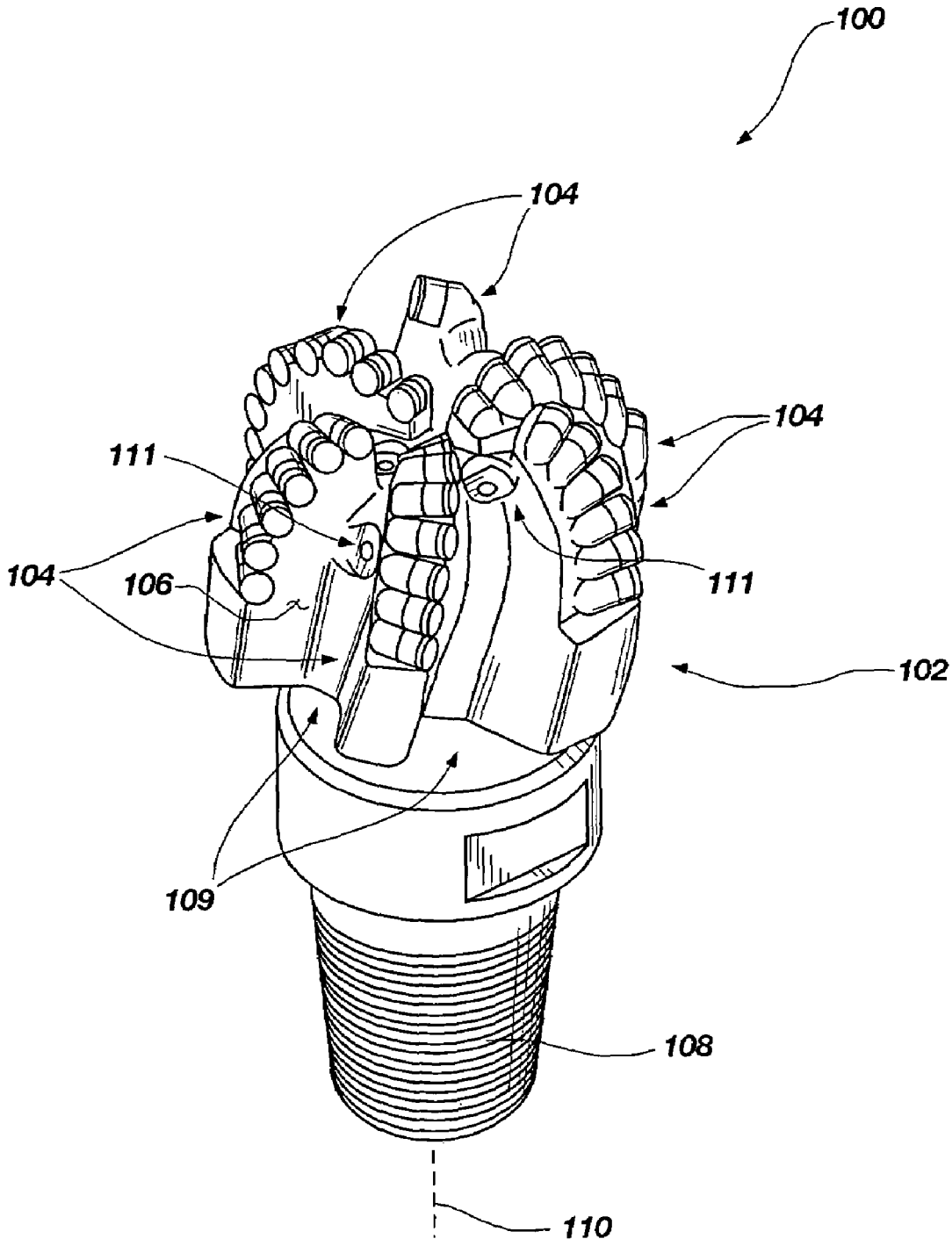
FIG. 1 (PRIOR ART)
FIG. 1 is an isometric view of a prior art rotary drill bit including a plurality of fixed cutting elements.
Figure 2:
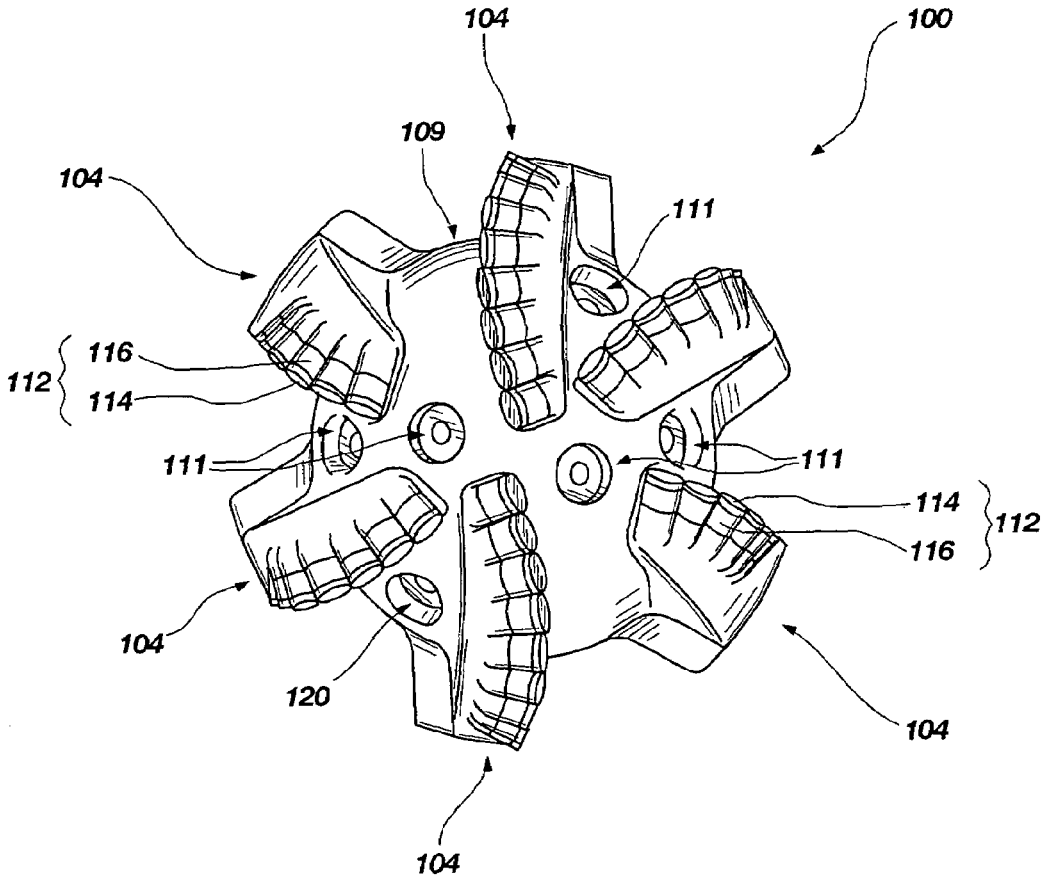
FIG. 2 (PRIOR ART)
FIG. 2 is a top elevation view of the rotary drill bit shown in FIG. 1.
Figure 3:
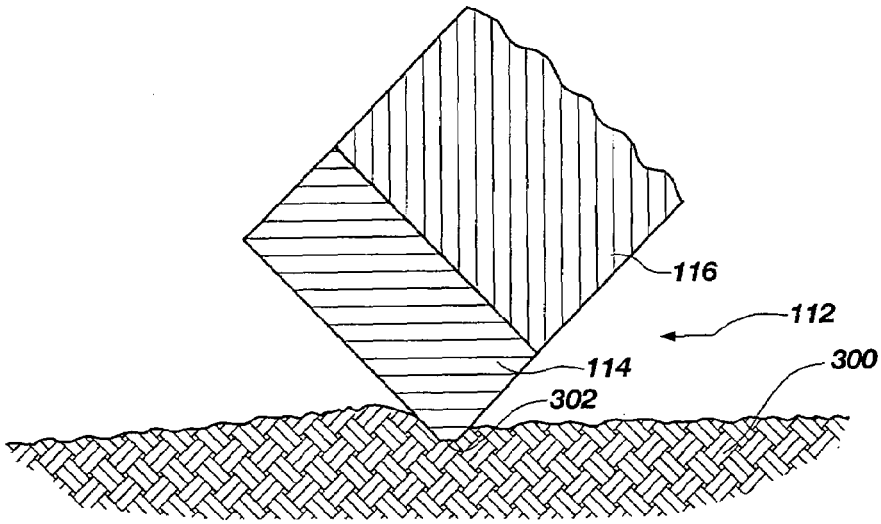
FIG. 3 (PRIOR ART)
FIG. 3 is a partial, side cross-sectional view of one of the cutting elements shown in FIGS. 1 and 2 illustrating localized wear of one of the cutting elements that can develop during drilling of a subterranean formation.

As shown in FIG. 12, the cutter assembly 1200 includes a housing 1202 that defines the recess 404 in which the cutter element 406 is received. Instead of an exterior surface 1204 of the housing 1202 being oriented generally parallel to the rotation axis A, the exterior surface 1204 is oriented at a selected rake angle θ relative to the rotation axis A. Thus, the cutter assembly 1200 may be mounted to a bit body of a drill bit, such as the bit body 102 shown in FIG. 1, so that the cutter element 406 is oriented with a side rake and/or back rake angle θ. For example, the side rake and/or back rake angle may be a positive or negative side and/or back rake angle. Providing a selected rake angle may help the surface features (such as the teeth 416 and 420 illustrated in FIG. 12) of the superabrasive table 408 engage a subterranean formation during drilling to further promote rotation of the cutting element 406. It should be noted that the housings of any of the disclosed cutter assemblies may be configured to provide a selected rake angle to a cutting element thereof, and the illustrated embodiment shown in FIG. 12 is merely one of many embodiments of cutter assemblies that can employ a housing with a selectively oriented exterior surface.

Although the above-described cutter assembly embodiments employ a cutting element including a superabrasive table with surface features configured to promote rotation of the cutting element, in other embodiments of the present invention, the surface features may be omitted. For example, in another embodiment of the present invention, a cutter assembly may comprise a cutter element that includes a superabrasive table with a cutting face exhibiting a generally planar surface geometry, a convex surface geometry, a concave surface geometry, or another cutting face geometry that is conventional in configuration. However, the cutting element may still be received generally within and coupled to a housing so that cutting operations may rotate the cutting element within the housing, as previously described, to improve wear uniformity and enhance operational lifetime of the cutting element. Additionally, as alluded to above, any of the above-described cutter assembly embodiments may be practiced without the use of bearing elements, if desired.

Figure 13:
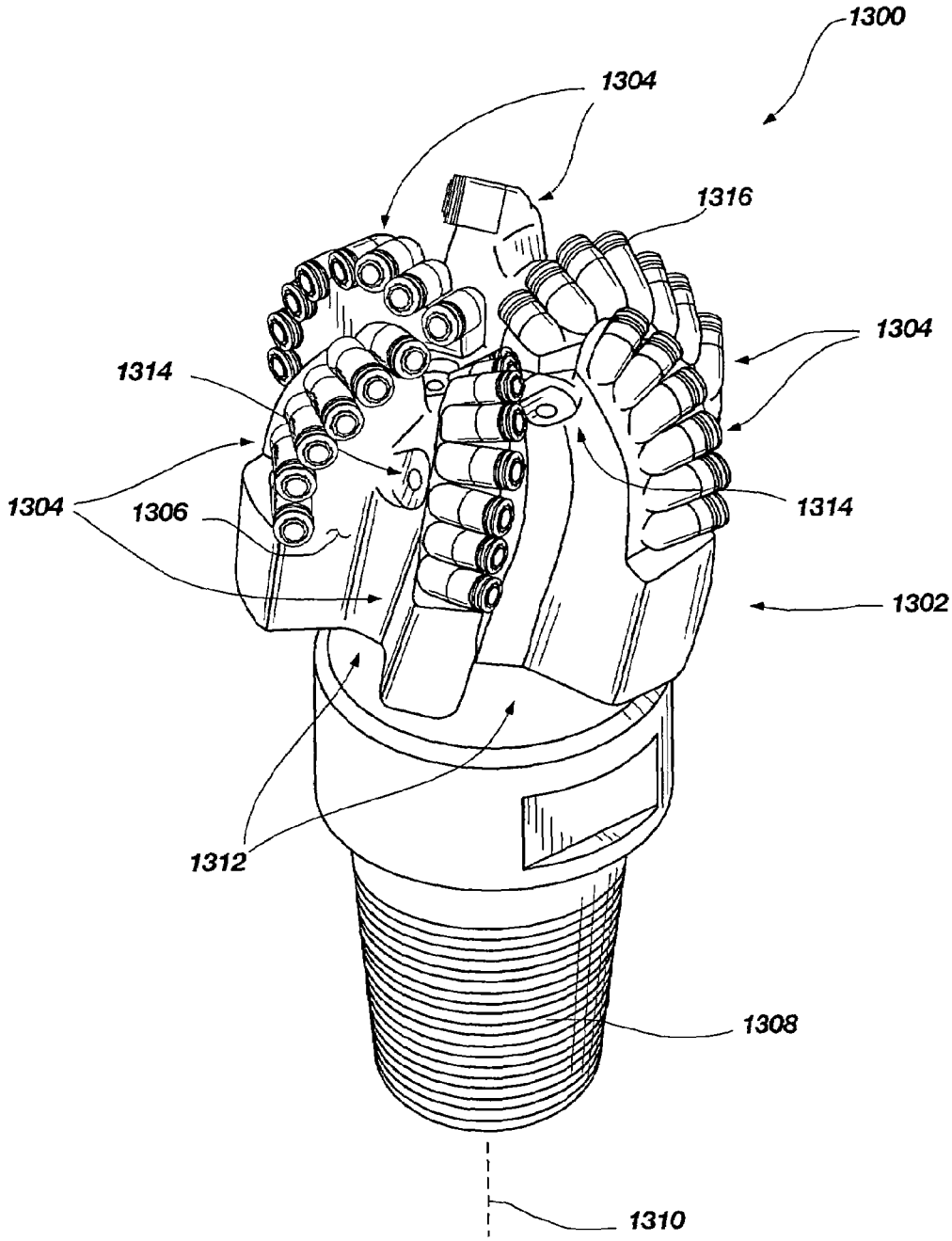
FIG. 13 is an isometric view of one embodiment of a rotary drill bit including at least one cutter assembly configured according any of the disclosed cutter assembly embodiments of the present invention.
Figure 14:
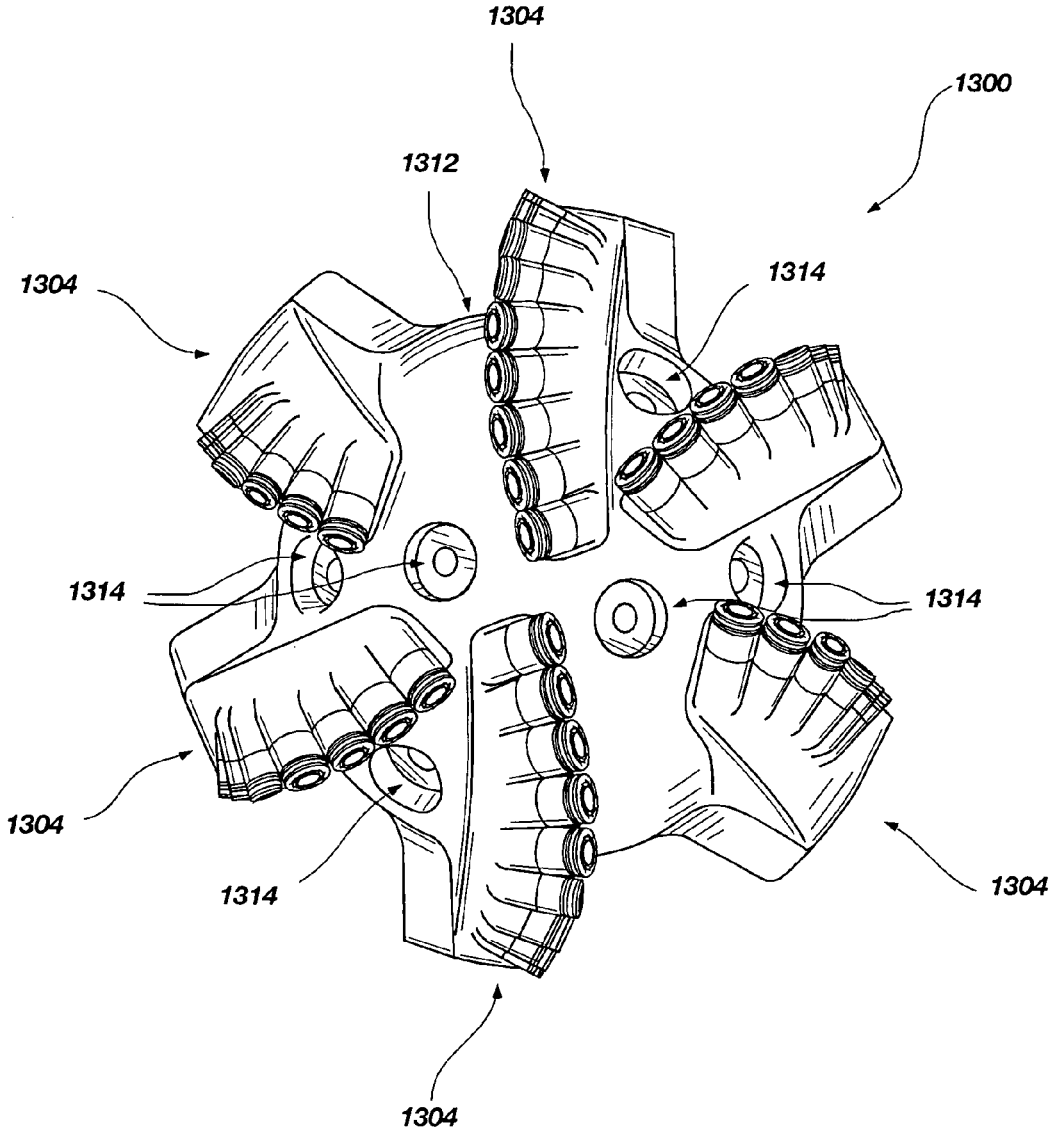
FIG. 14 is a top elevation view of the rotary drill bit shown in FIG. 13.

FIGS. 13 and 14 are isometric and top elevation views, respectively, of a rotary drill bit 1300 according to one embodiment of the present invention. The rotary drill bit 1300 includes at least one cutter assembly configured according to any of the disclosed cutter assembly embodiments of the present invention. The rotary drill bit 1300 comprises a bit body 1302 that includes radially- and longitudinally-extending blades 1304 with leading faces 1306, and a threaded pin connection 1308 configured for connecting the bit body 1302 to a drilling string. The bit body 1302 may made from steel, an infiltrated tungsten carbide material, or another suitable material. The bit body 1302 defines a leading end structure for drilling into a subterranean formation by rotation about a longitudinal axis 1310 and application of weight-on-bit. Circumferentially adjacent blades 1304 define so-called junk slots 1312 therebetween for channeling cuttings of the subterranean formation away from the bit body 1302. The bit body 1302 also may include a plurality of nozzle cavities 1314 for communicating drilling fluid from the interior of the bit body 1302 to a plurality of cutter assemblies 1316 during drilling.

At least one cutter assembly of the plurality of cutter assemblies 1316 may be configured according to any of the disclosed cutter assembly embodiments of the present invention and mounted to the bit body 1302. For example, as best shown in FIG. 14, each of the cutter assemblies 1316 is secured to one of the blades 1304 by brazing or press-fitting a housing thereof into a recess or pocket (not shown) formed in the bit body 1302. Although not shown, when the cutter assemblies 1316 are each configured as, for example, the cutter assembly shown in FIG. 11, fluid conduits may be provided within the bit body 1302 or passageways may be integrally formed within the bit body 1302 and fluidly coupled to such cutter assemblies to lubricate the cutting elements thereof. In addition, if desired, in some embodiments of the present invention, a number of the cutter assemblies 1316 may be replaced with fixed cutting elements that are conventional in construction.

During use, when the drill bit 1300 engages the subterranean formation, the cutting elements of each cutter assembly 1316 may rotate, as previously described, so that a cutting edge of each superabrasive table 1318 more uniformly wears.

FIGS. 13 and 14 merely depict an embodiment of a rotary drill bit that employs at least one cutter assembly configured in accordance with the disclosed embodiments, without limitation. The rotary drill bit 1300 is used to represent any number of earth-boring tools or drilling tools, including, for example, roller-cone bits, fixed-cutter bits, percussion bits or any other downhole tool that may benefit from utilizing a cutter assembly including a rotatable cutting element, without limitation.

Although the present invention has been disclosed and described by way of some embodiments, it is apparent to those skilled in the art that several modifications to the described embodiments, as well as other embodiments of the present invention are possible without departing from the spirit and scope of the present invention. Additionally, the words "including" and "having," as used herein, including the claims, shall have the same meaning as the word "comprising."

What is claimed is:

1. A cutter assembly, comprising:

a housing including a recess; and a cutting element received by and rotatable within the recess of the housing, the cutting element including:

a superabrasive table;

a substrate including a backing portion bonded to the superabrasive table and a shaft portion extending from the backing portion, the shaft portion including an end region spaced from the backing portion, at least part of the shaft portion positioned within the recess of the housing;

a retention element attached to the end region, the retention element including a flared portion that is completely enclosed by the housing, the flared portion of the retention element configured to restrict axial displacement of the cutting element within the recess;

an elongated superhard sleeve extending about at least part of the shaft portion of the substrate; and at least one of the substrate or the superabrasive table including surface features configured to promote rotation of the cutting element within the housing during drilling.

2. The cutter assembly of claim 1 wherein the elongated superhard sleeve comprises polycrystalline diamond.

3. The cutter assembly of claim 1 wherein the superabrasive table comprises at least a portion of the surface features.

4. The cutter assembly of claim 1 wherein the superabrasive table comprises a cutting face including the surface features, and further wherein the surface features comprise at least one body including a plurality of teeth, each of the teeth extending at least radially outward.

5. The cutter assembly of claim 4 wherein each of the teeth of the at least one body further extends circumferentially.

6. The cutter assembly of claim 1, further comprising:

at least one bearing element including a hole formed therethrough, with the shaft portion extending through the hole, the at least one bearing element located between a portion of the housing and the backing portion.

7. The cutter assembly of claim 1 wherein:

the substrate comprises a cemented-carbide material; and the retention element comprises a metallic material that exhibits a lower yield stress than that of the cemented-carbide material.

8. The cutter assembly of claim 1 wherein the recess comprises an enlarged-diameter portion exhibiting a first diameter and a reduced-diameter portion exhibiting a second diameter less than the first diameter, and further wherein the flared portion of the retention element resides within the enlarged-diameter portion.

9. The cutter assembly of claim 1 wherein the housing comprises a base portion including a fluid port formed therein that is in communication with the recess.

10. The cutter assembly of claim 1 wherein the housing comprises an exterior surface oriented at a non-zero, selected rake angle relative to the rotation axis.

11. The cutter assembly of claim 1 wherein:

the substrate comprises a cemented-carbide material; and the superabrasive table comprises at least one of the following:

polycrystalline diamond;

cubic boron nitride;

polycrystalline diamond and cubic boron nitride; or a diamond-silicon carbide composite.

12. The cutter assembly of claim 1 wherein the flared portion of the retention element is deformed radially outwardly.

13. The cutter assembly of claim 1 wherein the flared portion of the retention element is deformed radially outwardly, and wherein the housing is a single piece housing.

14. The cutter assembly of claim 1 wherein the substrate comprises at least a portion of the surface features.

15. The cutter assembly of claim 1 wherein the substrate and the superabrasive table comprise the surface features.

16. The cutter assembly of claim 1 wherein:

the superabrasive table comprises a cutting face and a circumferential surface adjacent to the cutting face; and the surface features comprise a plurality of circumferentially-spaced slots extending through the circumferential surface and the cutting face.

17. The cutter assembly of claim 1 wherein:

the surface features comprise a plurality of circumferentially-spaced projections;

the superabrasive table comprises a cutting face and a circumferential surface adjacent to the cutting face, the cutting face and the circumferential surface comprising the plurality of circumferentially-spaced projections.

18. The cutter assembly of claim 1 wherein the superabrasive table comprises a cutting face including the surface features, the surface features including a plurality of blades circumferentially distributed about a rotation axis of the cutting element.

19. A rotary drill bit, comprising:

a bit body configured to engage a subterranean formation; and a plurality of cutter assemblies affixed to the bit body, at least one of the cutter assemblies including:

a housing secured to the bit body, the housing including a recess; and a cutting element received by and rotatable within the recess of the housing, the cutting element including:

a superabrasive table;

a substrate including a backing portion bonded to the superabrasive table and a shaft portion extending from the backing portion, the shaft portion including an end region spaced from the backing portion, at least part of the shaft portion positioned within the recess of the housing;

a retention element attached to the end region, the retention element including a flared portion that is completely enclosed by the housing, the flared portion of the retention element configured to restrict axial displacement of the cutting element within the recess;

an elongated superhard sleeve extending about at least part of the shaft portion of the substrate; and at least one of the substrate or the superabrasive table including surface features configured to promote rotation of the cutting element within the housing during drilling.

* * * * *

UNITED STATES PATENT AND TRADEMARK OFFICE

CERTIFICATE OF CORRECTION

PATENT NO. : 7,762,359 B1
APPLICATION NO. : 11/895245
DATED : July 27, 2010
INVENTOR(S) : David P. Miess It is certified that error appears in the above-identified patent and that said Letters Patent is hereby corrected as shown below:

In the Specification

Column 3, Line 25, delete “rotation” and insert -- rotation of the --, therefor.

Column 6, Line 8, delete “retention element 410” and insert -- retention element 428 --, therefor.

Column 6, Line 16, delete “may HPHT processed” and insert -- may be HPHT processed --, therefor.

Column 9, Line 36, delete “includes” and insert -- include --, therefor.

Signed and Sealed this
Fifth Day of January, 2016

Michelle K. Lee

Michelle K. Lee
*Director of the United States Patent and Trademark Office*